US006334934B1

(12) United States Patent
Heinzmann

(10) Patent No.: US 6,334,934 B1
(45) Date of Patent: Jan. 1, 2002

(54) SEALING DEVICE AND PROCESS FOR SEALING PRESSURE ZONES IN A PAPER-MAKING MACHINE

(75) Inventor: Helmut Heinzmann, Böhmenkirch (DE)

(73) Assignee: Voith Sulzer Papiertechnik Patent GmbH, Heidenheim (DE)

( * ) Notice: Subject to any disclaimer, the term of this patent is extended or adjusted under 35 U.S.C. 154(b) by 0 days.

(21) Appl. No.: 09/398,139

(22) Filed: Sep. 17, 1999

(30) Foreign Application Priority Data

Sep. 18, 1998 (DE) ..... 198 42 838

(51) Int. Cl.[7] ..... D21F 3/10

(52) U.S. Cl. ..... 162/371; 162/367; 162/368; 162/369; 277/345; 277/906

(58) Field of Search ..... 162/199, 208, 162/217, 272, 278, 279, 297, 306, 308, 310, 318, 335, 351, 363, 364, 365, 366, 367, 368, 369, 370, 371, 372, 373, 374; 226/95; 277/300, 345, 906

(56) References Cited

U.S. PATENT DOCUMENTS

| | | | | |
|---|---|---|---|---|
| 2,274,641 A | * | 3/1942 | Abbott et al. | 162/371 |
| 2,649,719 A | | 8/1953 | Hornbostel | 162/371 |
| 4,714,523 A | * | 12/1987 | Sawyer, Jr. et al. | 162/371 |
| 4,915,787 A | * | 4/1990 | Branyon et al. | 162/199 |
| 4,957,598 A | * | 9/1990 | Corbellini | 162/363 |
| 5,262,010 A | * | 11/1993 | Bubik et al. | 162/352 |
| 5,580,424 A | * | 12/1996 | Snellman | 162/371 |
| 5,746,891 A | * | 5/1998 | Withers | 162/371 |
| 5,935,386 A | * | 8/1999 | Somervuori | 162/371 |
| 5,975,532 A | | 11/1999 | Karttunen et al. | 277/300 |

FOREIGN PATENT DOCUMENTS

| | | | |
|---|---|---|---|
| DE | 1135745 | 8/1962 | D21F/3/10 |
| DE | 1146350 | 3/1963 | D21F/3/10 |
| WO | 97/17490 | 5/1997 | D21F/3/10 |

* cited by examiner

*Primary Examiner*—Peter Chin
*Assistant Examiner*—Eric Hug
(74) *Attorney, Agent, or Firm*—Greenblum & Bernstein, P.L.C.

(57) ABSTRACT

Sealing device and process for laterally sealing at least one excess pressure or vacuum zone adjoining a moving surface in a paper-making machine. The sealing device has at least one sealing element arranged in a receptacle area of a holder and is movable relative to the holder for placement against the moving surface. The receptacle area serves as a clamping receptacle and the sealing element is acted upon with a clamping force through clamping surfaces of the clamping receptacle.

49 Claims, 5 Drawing Sheets

SEALING DEVICE AND PROCESS FOR SEALING PRESSURE ZONES IN A PAPER-MAKING MACHINE

CROSS-REFERENCE TO RELATED APPLICATIONS

The present application claims priority under 35 U.S.C. §119 of German Patent Application No. 198 42 838.3, filed Sep. 18, 1998, the disclosure of which is expressly incorporated by reference herein in its entirety.

BACKGROUND OF THE INVENTION

1. Field of the Invention

The invention relates to a sealing device for laterally sealing at least one excess pressure or vacuum zone adjoining a moving surface in a paper machine having at least one sealing element that is arranged at least locally in a receptacle area of a holder and is movable relative to the holder for placement against the moving surface.

The invention also relates to a process for laterally sealing at least one excess pressure or vacuum zone adjoining a moving surface in a paper making machine by way of a sealing device that includes at least one sealing element that is arranged at least locally in a receptacle area of a holder and is moved relative to the holder for placement against the moving surface.

Such sealing devices and processes are used, for example, to seal off from the environment the interior, which is under negative pressure, of a suction box whose lateral walls are provided with the sealing device by pressing the sealing elements against the rotating jacket of a suction roll over which the paper web to be dewatered is guided such that the sealing element sits optimally against the jacket and a good sealing effect is achieved.

2. Discussion of Background Information

There is disclosed in U.S. Pat. No. 5,580,424 a sealing element arranged in a holder and clamped to the holder, such a sealing element having a separate piston that is pressed against the sealing element by means of a spring. The spring is designed in such a way that a movement of the sealing element in the direction of a roll jacket is not prevented, but the sealing element is held when the pressure in an application pressure tube is eliminated.

In a device as disclosed in German Patent DE-AS 1 135 745, legs of a sealing strip are respectively arranged in a space between walls of a guide for the sealing strips, with the thickness of the respective legs being somewhat less than the width of the space between the walls. To reduce the penetration of air, a small pneumatic seal in the form of a rubber tube, which is connected to a pressurized air source and sits against the sealing strips in order to provide a seal, is provided between each sealing strip and the exterior walls of the guide.

Forming grooves for a sealing strip in the lateral walls of a holder and placing sealing tubes in those grooves that can unroll in the groove in the application pressure direction is known from U.S. Pat. No. 2,649,719. The sealing strip can move freely due to the unrolling tubes inside the slit formed by the lateral walls of the holder.

In a device as disclosed in German Patent DE-AS 1 146 350, sealing strips that can be pressed against the inner surface of a roll jacket are loosely guided in the body of a suction chamber and supported inside the suction chamber by pressure chambers and outside by ribs.

SUMMARY OF THE INVENTION

The invention resides in a sealing device and a process of the type described above that will provide uniformly good sealing of the pressure zone during operation in the simplest possible manner while avoiding application of excessive pressure.

This is achieved by having the receptacle area designed as a clamping receptacle and the sealing element being acted upon by a clamping force through clamping surfaces of the clamping receptacle.

This produces a frictionally-engaged connection between the holder and the sealing element which can hold the sealing element securely in the respective position in relation to the moving surface while simultaneously ensuring a seal between the holder and the sealing element.

Moreover, this allows the clamping force to be applied in such a way that the sealing element initially sits against the moving surface with an application force sufficient to overcome the clamping force and the application pressure can subsequently be reduced, whereupon the sealing element is held in its set sealing position by the clamping force exercised on the sealing element by the holder through its clamping surfaces.

According to an embodiment of the invention, at least one clamping surface is partially formed by a clamping body.

Such clamping body can be deliberately adjusted to the respective conditions of use. For example, if vibrations of the moving surface, particularly a rotating jacket of a suction roll or a ventilation roll, are anticipated which will affect the position of the sealing element, the clamping body that will contribute to the frictionally-engaged connection between the holder and the sealing element may be elastically ductile so that the vibrations transferred to the sealing element can be absorbed. The occurrence of a so-called "slip-stick" effect can be effectively prevented in this manner, so that the sealing element remains in its set position in relation to the roll jacket, in spite of the vibrations. An excess application pressure or surface pressure between the sealing element and the roll jacket is thus avoided, thereby reducing wear on the sealing element.

In contrast, the clamping body may be made of a less elastic material if no disruptive vibrations are expected and if the "slip-stick" effect, which is specifically desirable in the case of suction rolls with poor concentricity, is to be promoted.

According to the invention, a sealing device for laterally sealing at least one excess pressure or vacuum zone adjoins a moving surface in a paper-making machine, the sealing device comprising a holder, a receptacle area in the holder and at least one sealing element in the receptacle area. The sealing element is movable relative to the holder for placement against the moving surface. The receptacle area is designed as a clamping receptacle having clamping surfaces thereon. The sealing element is acted upon with a clamping force through the clamping surfaces of the clamping receptacle.

The sealing element substantially completely fills the receptacle area in at least one plane perpendicular to the direction of movement of the sealing element. The receptacle area is designed as a receptacle channel open to the moving surface, which channel has one of, a square or rectangular inner cross-sectional area, and the lateral surfaces delimiting the receptacle channel are designed as clamping surfaces. At least one clamping surface is partially formed by a clamping body, arranged in a groove that is formed in a lateral wall of the holder and is open to the sealing element.

In one embodiment of the invention, the clamping body comprises a seal element which is elastically ductile.

According to another embodiment of the invention, the clamping body includes a clamping pressure tube arranged between the sealing element and a lateral wall delimiting the receptacle area.

The sealing element is placed against the moving surface by way of at least one application pressure tube arranged between the sealing element and a delimiting surface of the receptacle area facing away from the moving surface. The pressures present in the application pressure tube and in the clamping pressure tube are at about the same level at least during placement or application of the sealing element against the moving surface. The application pressure tube and the clamping pressure tube are connected to a joint pressure circuit. The clamping pressure tube is arranged in a groove formed in the surface of the lateral wall.

According to another aspect of the invention, a piston is movable in the groove and arranged between the clamping pressure tube and the sealing element. The piston is made of a material having a low degree of elasticity.

According to the invention, the sealing element includes a wear section cooperating with the moving surface and a clamping section cooperating with the holder, wherein the wear section and the clamping section are made of two different materials. The holder is movable relative to the moving surface with a component that is parallel to the direction of placement. The holder is movably mounted, particularly spring mounted on one of, a suction or ventilation box.

The sealing device is used for laterally sealing at least one pressure zone adjoining the interior or exterior wall of a rotating jacket of one of, a suction roll, or a ventilation roll, or a moving belt. The device may be mounted between one of, a suction or ventilation box and a rotating jacket of one of, a suction roll, or a ventilation roll, or a moving belt.

The sealing element is designed as a sealing strip extending at least substantially over the entire roll length. The sealing element is acted upon by a clamping force through clamping surfaces of the holder. At least one clamping surface is formed at least partially by a clamping body arranged in a channel formed in a lateral wall of the holder and open to the sealing element, and that includes a clamping pressure tube arranged between the sealing element and a lateral wall delimiting the receptacle area. The sealing element can be placed against the moving surface by way of at least one application pressure tube, arranged between the sealing element and a delimiting surface of the receptacle area facing away from the moving surface. The pressures present in the application pressure tube and in the clamping pressure tube are at about the same level at least during placement or application of the sealing element against the moving surface. The application pressure tube and the clamping pressure tube are connected to a joint pressure circuit.

According to the invention, the sealing device is used for laterally sealing at least one of, excess pressure zone or vacuum zone adjoining a moving surface in a paper-making machine. The sealing device comprises a holder, lateral walls defined in said holder and at least one sealing element positioned inside said holder and movable relative thereto for placement against the moving surface. The sealing element has lateral walls in sliding contact and frictional engagement with the lateral walls on the holder. A clamping force is exerted by the lateral walls in said holder on the lateral walls of the sealing element to inhibit movement of the sealing element away from the moving surface.

The sealing device further comprises a groove formed in at least one of the lateral walls of the holder, the groove being open to the sealing element. A clamping body is arranged in the groove for inhibiting movement of the sealing element relative to the holder. The width of the seal element exceeds the width of the holder by about 0.05 mm, and preferably by about 0.1 mm.

The clamping body comprises a clamping pressure tube located in the groove and a piston arranged between the sealing element and the clamping pressure tube. The piston is made of a material selected from among rubber or plastic, such as polytetrafluoroethylene. The sealing element wear section is made of a material having good lubricating properties, such as a plastic material with high content graphite.

The holder is made of a different material than the clamping section. The material selected could be a mettalic material, e.g., special steel, brass, or bronze.

At least one application pressure tube is provided for moving the sealing element against the moving surface, the application pressure tube being arranged in the groove between the sealing element and a delimiting surface of the groove facing away from the moving surface.

A fluid pressure circuit supplies to the application pressure tube and to the clamping pressure tube about the same pressure level at least during application of the sealing element against the moving surface. The fluid pressure circuit comprises a common pressure circuit for the application pressure tube and the clamping pressure tube.

The sealing element comprises a wear section cooperating with the moving surface and a clamping section cooperating with the holder, the wear section and the clamping section being made of two different materials.

The holder is movable relative to the moving surface in a direction parallel to the direction of movement of the seal element. Additionally, the holder is spring mounted on one of, a suction or a ventilation box.

A chamber disposed between the bottom of the holder and the suction box. The chamber is open to ambient and further comprises a first seal disposed between the holder and the suction box. Alternatively, the chamber is open to the suction box and further comprises a second seal disposed between the holder and the suction box.

The sealing element comprises a wear section cooperating with the moving surface and a clamping section cooperating with the holder, the wear section being provided with a slope on one side thereof.

The invention contemplates a paper-making machine comprising a moving surface. An excess pressure zone or vacuum zone adjoins the moving surface. A sealing device for laterally sealing the zone comprises a holder, at least one sealing element positioned inside the holder and movable relative thereto for placement against the moving surface. The sealing element has lateral walls in sliding contact and frictional engagement with the lateral walls on the holder. A clamping force is exerted by the lateral walls in the holder on the lateral walls of the sealing element to inhibit movement of the sealing element away from the moving surface. A clamping body inhibits movement of the sealing element relative to the holder. The clamping body comprises a clamping pressure tube and a piston arranged between the sealing element and the clamping pressure tube. At least one application pressure tube moves the sealing element against the moving surface. A fluid pressure circuit supplies pressure to the application pressure tube and to the clamping pressure tube.

The invention is also attained by way of a process for applying a clamping force, through clamping surfaces of a clamping receptacle during its movement relative to the holder and in its applied state, on a sealing element in the clamping receptacle.

The process for laterally sealing at least one excess pressure or vacuum zone adjoining a moving surface in a paper-making machine by way of a sealing device that includes at least one sealing element, comprises arranging the sealing device in a receptacle area of a holder and placing the sealing device relative to the holder against the moving surface. The receptacle area is designed as a clamping receptacle. The process further comprises acting on the sealing element with a clamping force through clamping surfaces of the clamping receptacle during its movement relative to the holder and in its applied state.

Additionally, the process further comprises clamping the sealing element with a clamping force that is at least substantially constant over time. Further, the process comprises varying the clamping force as a function of at least one of, the distance of the sealing element from the moving surface or as a function of an application force that acts upon the sealing element for placement onto the moving surface.

The process further entails setting an application force as a function of the ratio between the clamping force and a bending force necessary for adjustment of the sealing element to the contour of the moving surface, once the sealing element has been placed against the moving surface. Additionally, the process entails reducing the application force, once the sealing element has been placed against the moving surface.

The process further comprises selecting the clamping force to be greater than a bending force and reducing the application force to approximately zero, once the sealing element has been placed against the contour of the moving surface.

According to another aspect of the invention, the process comprises selecting the clamping force to be less than a bending force and reducing the application force to approximately the difference between the bending force and the clamping force, once the sealing element has been placed against the contour of the moving surface.

Preferred embodiments of both the sealing device according to the invention and the sealing process according to the invention are further described in relation to the description and the drawings.

Other exemplary embodiments and advantages of the present invention may be ascertained by reviewing the present disclosure and the accompanying drawing.

BRIEF DESCRIPTION OF THE DRAWINGS

The present invention is further described in the detailed description which follows, in reference to the noted plurality of drawings by way of non-limiting exemplary embodiments of the present invention, in which like reference numerals represent similar parts throughout the several views of the drawings, and wherein.

DETAILED DESCRIPTION OF THE PRESENT INVENTION

The particulars shown herein are by way of example and for purposes of illustrative discussion of the embodiments of the present invention only and are presented in the cause of providing what is believed to be the most useful and readily understood description of the principles and conceptual aspects of the present invention. In this regard, no attempt is made to show structural details of the present invention in more detail than is necessary for the fundamental understanding of the present invention, the description taken with the drawings making apparent to those skilled in the art how the several forms of the present invention may be embodied in practice.

Figure 1A:
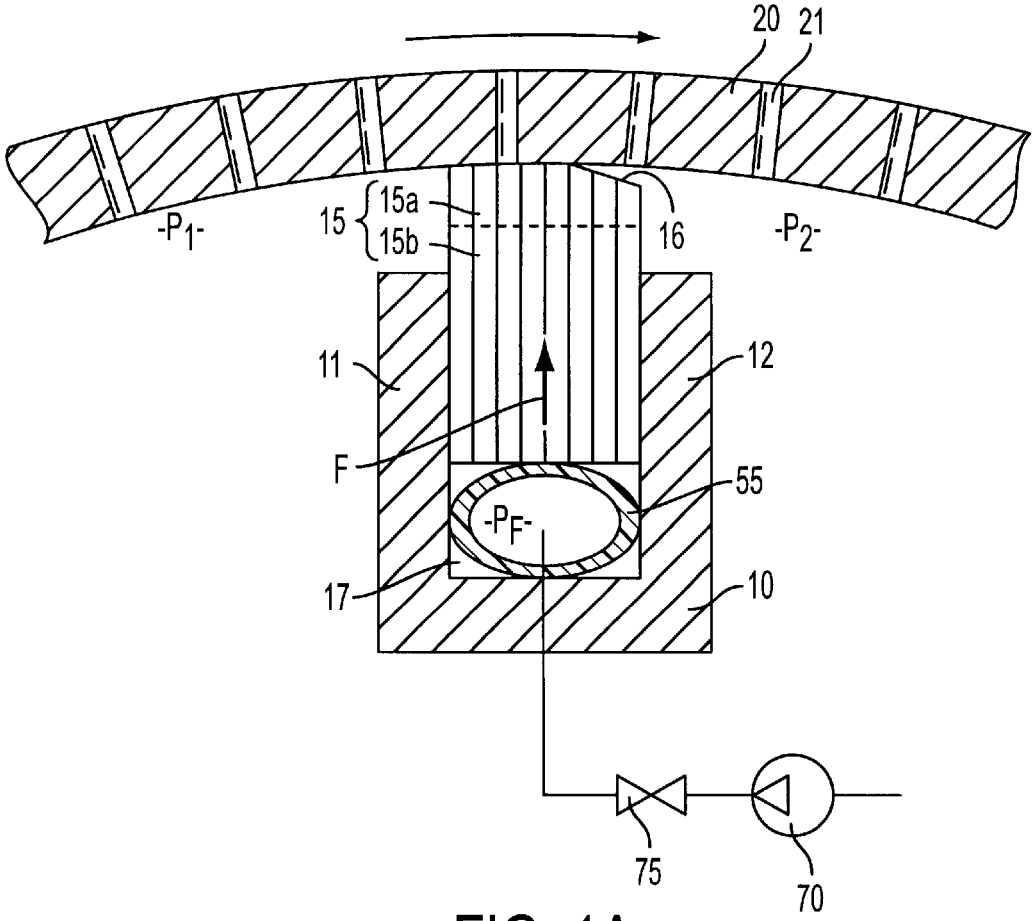
FIG. 1*a* shows a lateral view of a sealing device according to a first embodiment of the invention.

The sealing device according to the invention shown in FIG. 1*a* is used to separate two pressure zones $P_1$, $P_2$, which adjoin the interior wall of a jacket 20 that rotates relative to the sealing device in the direction of the arrow during operation, which jacket is an integral part of a suction roll of a paper making machine (not shown), and a moving surface. The jacket 20 is provided with holes 21 through which moisture can be drawn from a paper web to be dewatered.

The sealing device is mounted in a suction box (not shown), in whose interior pressure $P_1$, which is less than ambient pressure $P_2$, is present during suction operation. An additional sealing device designed according to the invention which seals the interior of the suction box toward the other side, is provided in the circumferential direction at a distance from the sealing device shown in FIG. 1*a*.

The sealing device includes a holder 10 that has a U-shaped cross section in a plane perpendicular to the rotational axis of the suction roll and preferably extends substantially over the entire roll length. A sealing element 15, which is designed as a sealing strip also extending approximately over the entire roll length, is wedged tightly into the holder 10 in such a way that the lateral walls 11, 12 of the holder 10, which laterally delimit the sides of a channel-like receptacle area 17 for the sealing element 15, sit flat against the outer walls of the sealing element 15.

The width of the receptacle channel 17 of the holder 10 is dimensioned as a function of the width of the sealing element 15 and the material characteristics of the sealing element 15 in such a way that the sealing element 15 sits tightly in the holder 10 and is not freely movable in either the axial or radial direction.

In that manner, the receptacle area 17 forms a clamping receptacle for the sealing element 15. The surfaces of the lateral walls 11, 12 of the holder 10 that face the sealing element 15 form clamping surfaces of the clamping receptacle which provide a frictionally-engaged connection between the sealing element 15 and the holder 10 and act with a static friction force or clamping force on the sealing element 15.

As shown by the broken line in FIG. 1*a,* the sealing element 15 can include two different sections 15*a,* 15*b.* A wear section 15*a* that cooperates with the jacket 20 may be of a different material than clamping section 15*b* with which the sealing element 15 is clamped into the holder 10. The material selected for wear section 15*a* may be a plastic material with high content graphite, or another material with good lubricating properties. The holder 10 may be made of a metal, such as special steel, brass, or bronze, and is made of a material different than clamping section 15*b*. In that way, the material of both sections 15*a*, 15*b* of the sealing element 15 can be optimally adapted to the respective function to be fulfilled. The wear section 15*a* is provided with a slope 16 on one side.

Between the bottom of the receptacle channel 17 and the sealing element 15 is arranged an application pressure tube 55 that also extends approximately over the entire length of the roll and is connected to a fluid pressure source 70 that is connected to a fluid reservoir (not shown). The flow connection between the fluid pressure source 70 and the application pressure tube 55 can be interrupted using a valve 75.

When pressure $P_F$ inside the application pressure tube 55 is increased, the application pressure tube 55 expands so that the sealing element 15 can be slid out of the holder 10 against the clamping force exercised by the lateral walls 11, 12 of the holder 10 on the sealing element 15 and placed against the jacket 20. Application force F exercised by the application pressure tube 55 on the sealing element 15 is shown by an arrow in FIG. 1*a*.

The sealing element 15 is preferably placed against the jacket 20 in such a way that a minimal sealing gap that ensures sufficient tightness is present.

Figure 1B:
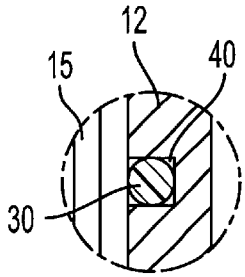
FIG. 1*b* shows a detail enlarged in relation to FIG. 1*a* of a sealing device according to the invention which has been modified from the embodiment of FIG. 1*a;*

According to the modification shown in FIG. 1*b*, at least one groove 40 extending in the longitudinal direction of the holder 10 can be provided in at least one of the lateral walls 11, 12 of the holder 10, in which groove a seal element 30 with a circular cross-section, for example, in the form of an O-ring, is arranged.

The side of the seal element 30 facing the sealing element 15 forms a part of the clamping surface, thereby contributing to the frictionally-engaged connection between the holder 10 and the sealing element 15. The seal element 30 can therefore be described as a clamping body.

A movement of the seal element 30 in the direction of movement of the sealing element 15 is prevented, since in that direction the width of groove 40 corresponds to the dimension of the seal element 30, i.e., the diameter of the seal element 30. The width of seal element 30 exceeds the width of the holder by about 0.05 mm, and preferably by about 0.1 mm.

Figure 2:
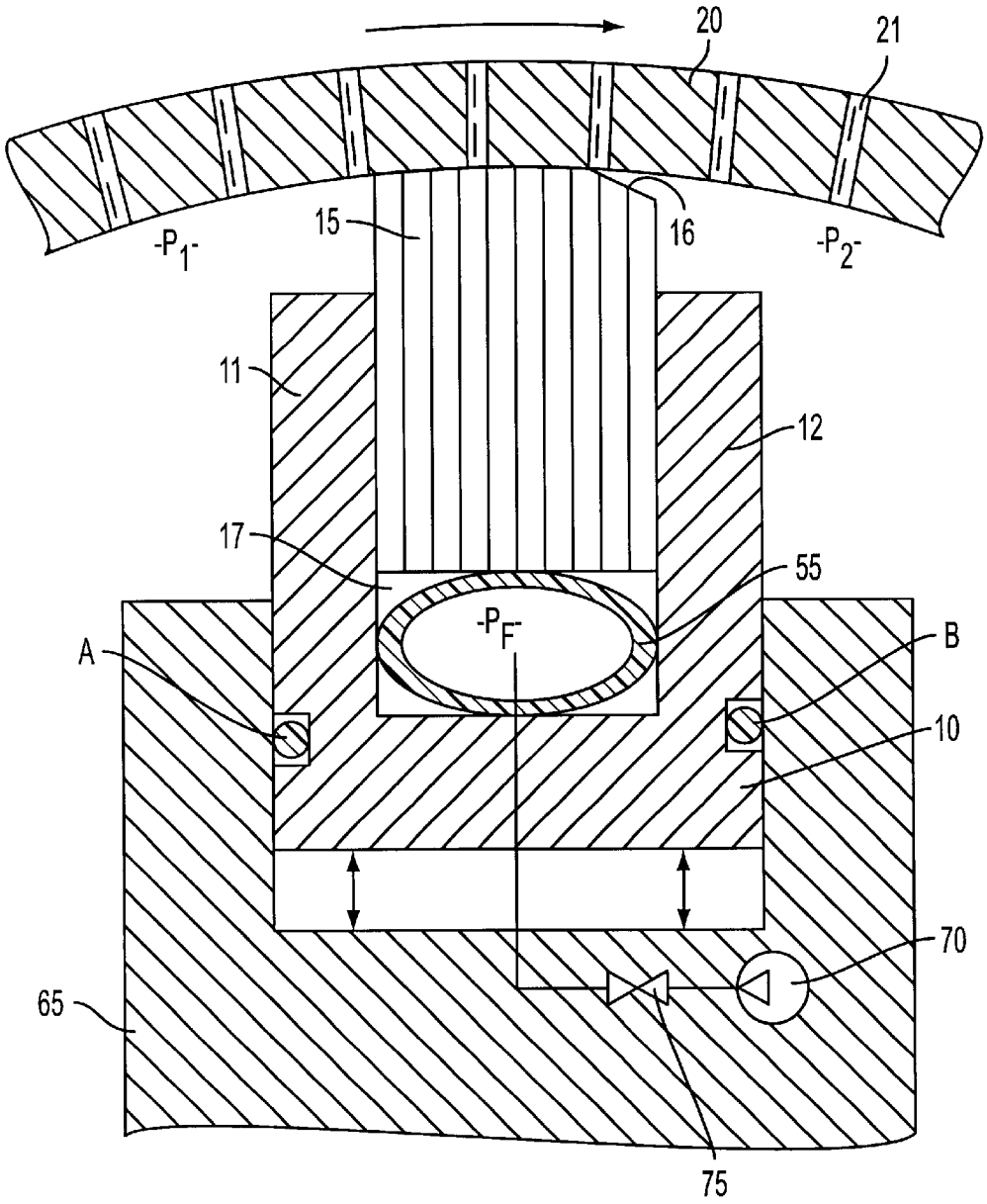
FIG. 2 shows an additional embodiment of a sealing device according to the invention.

The embodiment of the sealing device according to the invention shown in FIG. 2 differs from the embodiment shown in FIG. 1*a* in that the holder 10 is arranged in a receptacle channel of a suction box 65 (only partially shown) and is movable relative to the suction box 65, as shown by the double arrows.

That design allows presetting of the distance between the holder 10 and the jacket 20 of the suction roll, so that a comparatively low pressure increase in the application pressure tube 55 is sufficient to apply the sealing element 15 against the jacket 20.

Another advantage is that the application pressure tube 55 need only change its volume due to the slight pressure increase, without having to be extended, in order to cause the necessary lifting movement of the sealing element 15. That creates a linear connection between the pressure $P_F$ and the application pressure between the sealing element 15 and the jacket 20 independent of the application path.

Just as the holder 10 forms a clamping receptacle for the sealing element 15, the suction box 65 can also be constructed as a clamping receptacle in the spirit of the invention for the holder 10. The space between the bottom of holder 10 and suction box 65 could be open to ambient (pressure P2), in which case seal B is necessary, or to the suction box (pressure P1), in which case seal A is necessary.

The holders 10 of the other described embodiments of the sealing device according to the invention can also be constructed to be adjustable for the purpose of a rough adjustment in relation to the jacket 20.

Figure 3A:
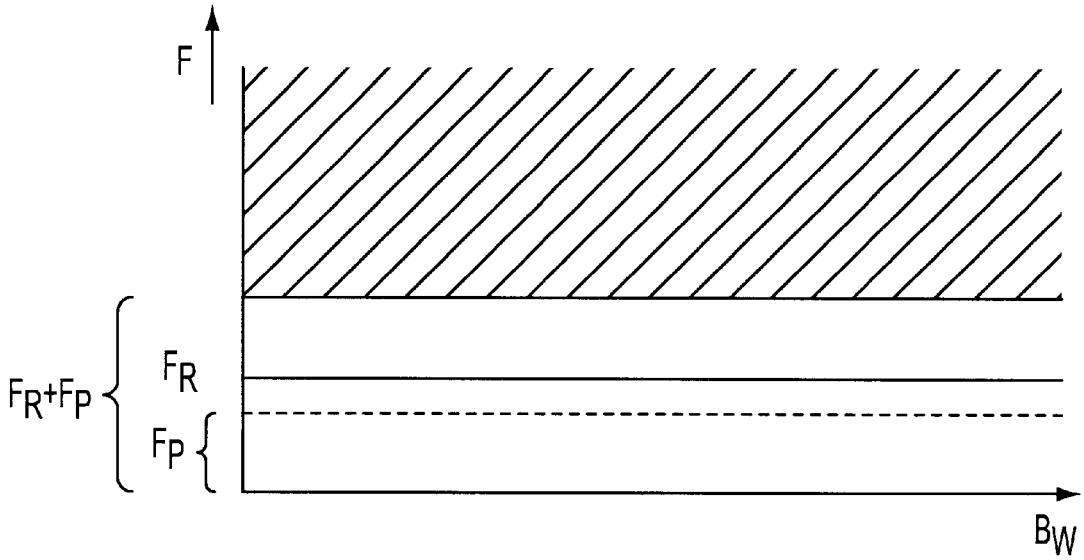
FIG. 3*a* shows a diagram to explain the principles of the forces acting on a sealing element of the sealing device according to the invention.

FIG. 3*a* explains the forces acting on the sealing element 15; in the diagram the forces are applied through the extension of the sealing element 15 along the axis of rotation of the suction roll, i.e., over roll width $B_W$.

$F_P$ refers to the force applied downwardly as a bending force, which is necessary to adjust the sealing element 15 to the contour of the roll jacket 20 which, for example, can deviate from a linear course due to deflection of the roll. Whereas in FIG. 3*a* bending force $F_P$ is shown to be approximately constant over the length of the sealing element 15, a different curve for bending force $F_P$ may occur in practice.

The static friction force acting between the sealing element 15 and the holder 10 due to the clamping of the sealing element 15 in the holder 10 is referred to as $F_R$ in FIG. 3*a;* in this case it can be assumed that static friction force $F_R$ is greater than bending force $F_P$. Static friction force $F_R$ is also applied downwardly as a clamping force.

To be able to press the sealing element 15 against the jacket 20 in such a way that the sealing element 15 sits against the jacket 20 along the entire length of the suction roll such that it forms a seal, pressure $P_F$ in the application pressure tube 55 must be raised to such an extent that application force F is greater than the sum $F_R+F_P$ and therefore lies in the shaded area of FIG. 3*a*.

Figure 3B:
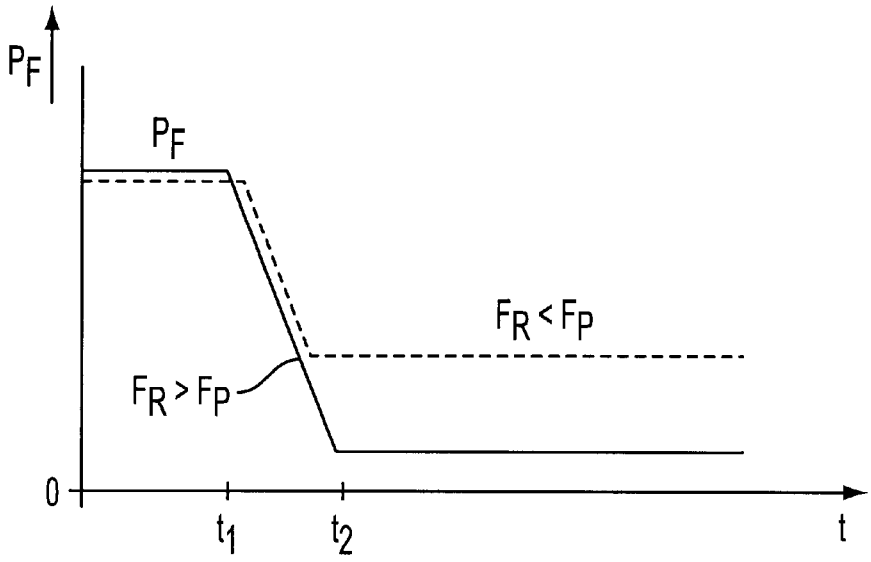
FIG. 3*b* shows possible time curves of the pressure level in an application pressure tube of the sealing device according to the invention.

FIG. 3*b*, which shows the pressure $P_F$ inside the application pressure tube 55 over time t, uses a broken line to show an example of the case in which $F_R>F_P$.

After the sealing element 15 has been adjusted to the contour of the jacket 20 under the effect of a constant high pressure $P_F$, pressure $P_F$ (and therefore application force F) is reduced between times $t_1$, and $t_2$ to a constant low value, preferably slightly above zero. Because static friction force or clamping force $F_R$ is greater than bending force $F_P$, the sealing element 15 cannot independently move out of its optimum applied state, i.e., out of its desired sealing position. That means that merely clamping the sealing element 15 between the lateral walls 11, 12 of the holder 10 maintains the state of optimum sealing between the sealing element 15 and the jacket 20.

The broken line in FIG. 3*b* shows the case in which $F_R<F_P$, in which the clamping force $F_R$ is not sufficient to maintain the sealing element 15 in its position adjusted to the contour of the jacket 20. In this case, the pressure $P_F$ in the application pressure tube 55 is only reduced at most to the extent that the application force F corresponds at least approximately to the difference between the bending force and the clamping force, i.e., where $F \approx F_P - F_R$.

The static friction force $F_R$ between the holder 10 and the sealing element 15 is supported in this case to some extent by the application force F exercised by the application pressure tube 55 on the sealing element 15, in order to overcome bending force $F_P$ and press the sealing element 15 over the entire length of the suction roll on its jacket 20 such that it forms a seal.

If, in a case not shown in FIG. 3*b*, vibrations of the jacket 20 occur and are transferred to the sealing element 15, that can lead to a time variation in the bending force $F_P$ to be provided by the sealing device. To maintain the state of optimum sealing in such a case as well, the fluid pressure $P_F$ in the application pressure tube 55 is set in such a way that the application force is at all times at least as great as the bending force, i.e., $F \geqq F_P$.

Figure 4:
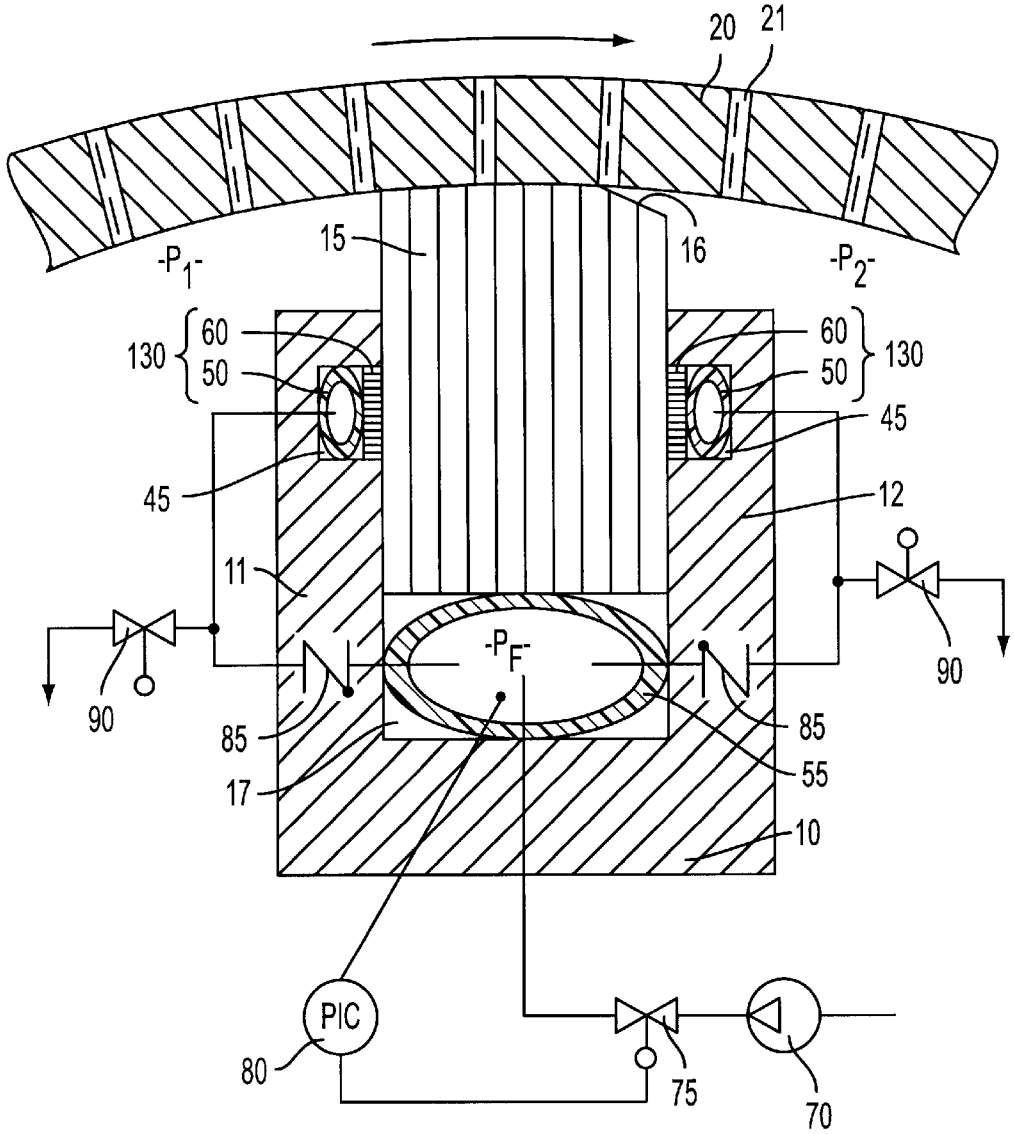
FIG. 4 shows a lateral view of a further embodiment of the sealing device according to the invention.

FIG. 4 shows an embodiment of the sealing device according to the invention in which, in contrast to the embodiments described above, a respective arrangement of a clamping pressure tube 50 and a piston 60 that can be acted upon by the clamping pressure tube 50 is provided as clamping bodies 130.

The clamping pressure tubes 50 and the pistons 60 each extend in the axial direction over the entire length of the roll inside the grooves 45 that are formed in the lateral walls 11, 12 of the holder 10 and are open to the sealing element 15.

The sides of the pistons 60 facing the sealing element 15 each form one part of the clamping surface for the sealing element 15, thereby contributing to the frictionally-engaged connection between the holder 10 and the sealing element 15.

The application pressure tube 55, provided for placement of the sealing element 15 against the jacket 20 of the suction roll, and the two clamping pressure tubes 50 are connected to a joint pressure circuit in which the pressure can be controlled using a fluid pressure source 70 and a valve 75. Consequently, the same fluid pressure $P_F$ is present in the application pressure tube 55 and in the clamping pressure tubes 50 when the sealing element 15 is placed or applied against the moving surface 20.

When the sealing element 15 has reached the desired sealing position after being placed or applied and the pressure $P_F$ is reduced, the return fittings 85 prevent the pressure in clamping pressure tubes 50 from falling. The clamping force exercised by the clamping bodies 130 is therefore maintained. The valves 90 are used to let off pressure from the clamping pressure tubes 50 and thus to reduce or increase that clamping force.

FIG. 4 also shows, in an area of the valve 75 connected to the pressure circuit and communicating with the application pressure tube 55, a pressure regulation or control device 80 that is designed to regulate or control the valve position as a function of fluid pressure $P_F$ measured by it in the application pressure tube 55. Such a pressure regulation device can also be used in the other described embodiments of the sealing device according to the invention.

With the embodiment shown in FIG. 4, it is possible to change the static friction force or the clamping force $F_R$ on the clamping surface provided by the piston 60 as a function of the respective conditions of use, without the need for a separate fluid pressure circuit. In that regard, the geometric conditions and properties of the clamping pressure tubes 50, the pistons 60, and the application pressure tube 55 can be selected according to the respective purpose and in particular can be coordinated with each other.

The embodiment shown in FIG. 4 makes it possible initially to operate with a comparatively high pressure $P_F$, which is necessary to shift the sealing element 15 in relation to the holder 10 and (once the desired sealing position of the sealing element 15 is reached) to reduce the pressure $P_F$. Because a pressure drop in the clamping pressure tubes 50 is prevented by the return fittings 85, the clamping force exercised by the clamping bodies 130 on the sealing element 15 is maintained, so that the sealing element 15 continues to be secured in its sealing position.

The pistons 60 can be elastically ductile and made of a material having the desired elasticity. A high elasticity of the pistons 60 is advantageous if vibrations of the roll jacket 20 are anticipated, which will be transferred to the sealing element 15. Such vibrations can be absorbed by the pistons 60, so that no "slip-stick" effect occurs and the sealing element 15 remains in the optimum sealing position in relation to the jacket 20. Some examples of materials selected for pistons 60 are rubber or plastic, such as polytetrafluoroethylene (teflon)™.

On the other hand, a slight elasticity of the pistons is advantageous if no vibrations are anticipated from the roll jacket 20 and the sealing device is used on a suction roll with poor concentricity, because the "slip-stick" effect that is desired in such cases is promoted.

Figure 5:
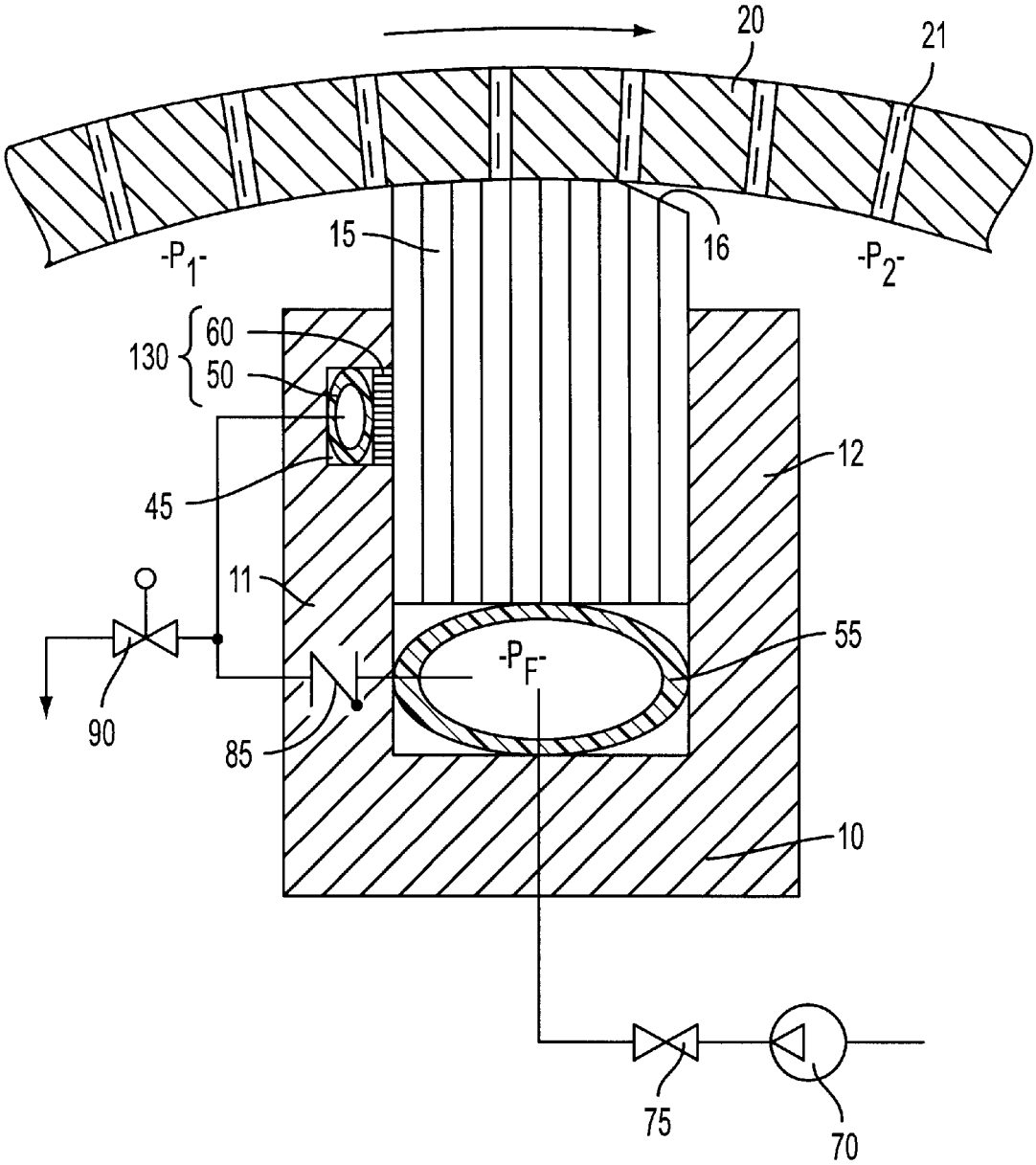
FIG. 5 shows a lateral view of an embodiment of a sealing device according to the invention which has been modified from the embodiment shown in FIG. 4.

The embodiment of a sealing device according to the invention shown in FIG. 5 is distinguished from the embodiment shown in FIG. 4 in that only one clamping body 130 including a clamping pressure tube 50 and a piston 60 is provided in one lateral wall 11 of the holder 10, and the same pressure $P_F$ as in the application pressure tube 55 is present in the clamping pressure tube 50 during placement or application of the sealing element 15 against the moving surface 20.

It is noted that the foregoing examples have been provided merely for the purpose of explanation and are in no way to be construed as limiting of the present invention. While the present invention has been described with reference to an exemplary embodiment, it is understood that the words which have been used herein are words of description and illustration, rather than words of limitation. Changes may be made, within the purview of the appended claims, as presently stated and as amended, without departing from the scope and spirit of the present invention in its aspects. Although the present invention has been described herein with reference to particular means, materials and embodiments, the present invention is not intended to be limited to the particulars disclosed herein; rather, the present invention extends to all functionally equivalent structures, methods and uses, such as are within the scope of the appended claims.

LIST OF REFERENCE CHARACTERS

10 Holder
11, 12 Lateral wall
15 Sealing element
15*a* Wear section
15*b* Clamping section
16 Slope
17 Receptacle area, receptacle channel
20 Moving surface, jacket
21 Holes
30 Clamping body, seal element
130 Clamping body
40, 45 Groove
50 Clamping pressure tube
55 Application pressure tube
60 Piston
65 Suction box
70 Fluid pressure source
75 Valve
80 Pressure regulation or control device
85 Return fitting
90 Valve
$P_1$, $P_2$ Pressure zones
$P_F$ Fluid Pressure
F Application force
$F_R$ Clamping force, static friction force $F_P$ Bending force
$B_W$ Roll width
A, B Seals

What is claimed is:

1. A sealing device for laterally sealing at least one excess pressure or vacuum zone adjoining a moving surface in a paper-making machine, the sealing device comprising:

a holder;

a receptacle area in said holder;

at least one sealing element in said receptacle area;

said sealing element being movable relative to the holder for placement against the moving surface;

wherein the receptacle area serves as a clamping receptacle;

the clamping receptacle having clamping surfaces thereon; and the sealing element is acted upon with a clamping force through the clamping surfaces of the clamping receptacle, wherein at least one of the clamping surfaces of the clamping receptacle is a lateral wall of the holder which includes a groove formed therein and a clamping body arranged inside the groove, the clamping body being an elastically ductile seal element which frictionally engages the sealing element to promote a slip-stick effect.

2. The sealing device according to claim 1, wherein the sealing element substantially completely fills the receptacle area in at least one plane perpendicular to the direction of movement of the sealing element.

3. The sealing device according to claim 1, wherein the receptacle area is in the form of a receptacle channel open to the moving surface, which channel has one of, a square or rectangular inner cross-sectional area, and the lateral surfaces delimiting the receptacle channel form clamping surfaces.

4. The sealing device according to claim 1, wherein the clamping body includes a clamping pressure tube arranged between the sealing element and a lateral wall delimiting the receptacle area.

5. The sealing device according to claim 4, wherein the sealing element is placed against the moving surface using at least one application pressure tube arranged between the sealing element and a delimiting surface of the receptacle area facing away from the moving surface.

6. The sealing device according to claim 5, wherein pressures present in the application pressure tube and in the clamping pressure tube are at about the same level at least during placement or application of the sealing element against the moving surface.

7. The sealing device according to claim 5, wherein the application pressure tube and the clamping pressure tube are connected to a joint pressure circuit.

8. The sealing device according to claim 4, wherein the clamping pressure tube is arranged in a groove formed in the surface of the lateral wall.

9. The sealing device according to claim 8, further comprising a piston movable in the groove and arranged between the clamping pressure tube and the sealing element.

10. The sealing device according to claim 9, wherein the piston is made of a material having a low degree of elasticity.

11. The sealing device according to claim 1, wherein the sealing element includes a wear section cooperating with the moving surface and a clamping section cooperating with the holder, wherein the wear section and the clamping section are made of two different materials.

12. The sealing device according to claim 1, wherein the holder is movable relative to the moving surface with a component that is parallel to the direction of placement.

13. The sealing device according to claim 1, wherein the holder is movably mounted on one of, a suction or ventilation box.

14. The sealing device according to claim 13, wherein the holder is spring mounted.

15. The sealing device according to claim 1, for laterally sealing at least one pressure zone adjoining the interior or exterior wall of a rotating jacket of one of, a suction roll, or a ventilation roll, or a moving belt.

16. The sealing device according to claim 1, for use between one of, a suction or ventilation box and a rotating jacket of one of, a suction roll, or a ventilation roll, or a moving belt.

17. The sealing device according to claim 1, wherein the sealing element comprises a sealing strip extending at least substantially over the entire roll length.

18. The sealing device according to claim 1, wherein the sealing element is acted upon by a clamping force through clamping surfaces of the holder, in which at least one clamping surface is formed at least partially by a clamping body arranged in a channel formed in a lateral wall of the holder and open to the sealing element, and that includes a clamping pressure tube arranged between the sealing element and a lateral wall delimiting the receptacle area, in which the sealing element is placed against the moving surface using at least one application pressure tube, arranged between the sealing element and a delimiting surface of the receptacle area facing away from the moving surface, and in which the pressures in the application pressure tube and in the clamping pressure tube are at about the same level at least during placement or application of the sealing element against the moving surface, and the application pressure tube and the clamping pressure tube are connected to a joint pressure circuit.

19. A sealing device for laterally sealing at least one of, an excess pressure zone or a vacuum zone adjoining a moving surface in a paper-making machine, the sealing device comprising:

a holder;

lateral walls defined in said holder;

at least one sealing element positioned inside said holder and movable relative thereto for placement against the moving surface;

said sealing element having lateral walls in sliding contact and frictional engagement with the lateral walls on the holder; and a clamping force being exerted by the lateral walls in said holder on the lateral walls of the sealing element to inhibit movement of the sealing element away from said moving surface, wherein the sealing element comprises a wear section cooperating with the moving surface and a clamping section cooperating with the holder, and wherein the wear section and the clamping section are made of different materials.

20. The sealing device according to claim 19, further comprising:

a groove formed in at least one of the lateral walls of the holder, said groove being open to the sealing element; and a clamping body arranged in said groove for inhibiting movement of said sealing element relative to said holder.

21. The sealing device according to claim 20, wherein the clamping body comprises a seal element.

22. The sealing device according to claim 21, wherein the width of the seal element exceeds the width of the holder by about 0.05 mm.

23. The sealing device according to claim 21, wherein the width of the seal element exceeds the width of the holder by about 0.1 mm.

24. The sealing device according to claim 20, wherein the clamping body is elastically ductile.

25. The sealing device according to claim 20, wherein the clamping body comprises:

a clamping pressure tube located in said groove; and a piston arranged between the sealing element and said clamping pressure tube.

26. The sealing device according to claim 20, further comprising at least one application pressure tube for moving the sealing element against the moving surface, said application pressure tube being arranged in said groove between the sealing element and a delimiting surface of the groove facing away from the moving surface.

27. The sealing device according to claim 26, further comprising a fluid pressure circuit for supplying to the application pressure tube and to the clamping pressure tube about the same pressure level at least during application of the sealing element against the moving surface.

28. The sealing device according to claim 27, wherein the fluid pressure circuit comprises a common pressure circuit for the application pressure tube and the clamping pressure tube.

29. The sealing device according to claim 26, further comprising a piston movable in the groove and arranged between the clamping pressure tube and the sealing element.

30. The sealing device according to claim 29, wherein the piston is made of a material having a low degree of elasticity.

31. The sealing device according to claim 30, wherein the piston is made of a material selected from among rubber or plastic.

32. The sealing device according to claim 31, wherein the piston is made of polytetrafluoroethylene.

33. The sealing device according to claim 19, wherein the wear section is made of a material having good lubricating properties.

34. The sealing device according to claim 33, wherein the wear section is made of a plastic material with high content graphite.

35. The sealing device according to claim 19, wherein the holder is made of a different material than the clamping section.

36. The sealing device according to claim 35, wherein the holder is made of a metallic material.

37. The sealing device according to claim 36, wherein the holder is made of, one of, special steel, brass, or bronze.

38. The sealing device according to claim 19, wherein the holder is movable relative to the moving surface in a direction parallel to the direction of movement of the seal element.

39. The sealing device according to claim 38, further comprising a chamber disposed between the bottom of the holder and the suction box.

40. The sealing device according to claim 39, wherein the chamber is open to ambient and further comprising a first seal disposed between the holder and the suction box.

41. The sealing device according to claim 39, wherein the chamber is open to the suction box and further comprising a second seal disposed between the holder and the suction box.

42. The sealing device according to claim 19, wherein the holder is spring mounted on one of, a suction or a ventilation box.

43. The sealing device according to claim 19, wherein said zone adjoins the interior or exterior wall of a rotating jacket of one of, a suction roll, or a ventilation roll, or a moving belt.

44. The sealing device according to claim 19, wherein the sealing element is designed as a sealing strip extending at least substantially over the entire roll length.

45. The sealing device according to claim 19, wherein the sealing element comprises a wear section cooperating with the moving surface and a clamping section cooperating with the holder, wherein the wear section is provided with a slope on one side thereof.

46. A paper-making machine comprising:

a moving surface;

an excess pressure zone or a vacuum zone adjoining said surface;

a sealing device for laterally sealing said zone, said sealing device comprising a holder, at least one sealing element positioned inside said holder and movable relative thereto for placement against the moving surface, said sealing element having lateral walls in sliding contact and frictional engagement with the lateral walls on the holder and a clamping force being exerted by the lateral walls in said holder on the lateral walls of the sealing element to inhibit movement of the sealing element away from said moving surface;

a clamping body for inhibiting movement of said sealing element relative to said holder, said clamping body comprising a clamping pressure tube and a piston arranged between the sealing element and said clamping pressure tube;

at least one application pressure tube for moving the sealing element against the moving surface;

a fluid pressure circuit for supplying pressure to the application pressure tube and to the clamping pressure tube; and further comprising at least one of:

at least one of the clamping surfaces of the clamping receptacle being a lateral wall of the holder which includes a groove formed therein and a clamping body arranged inside the groove, the clamping body being an elastically ductile seal element which frictionally engages the sealing element; and the sealing element comprising a wear section cooperating with the moving surface and a clamping section cooperating with the holder, the wear section and the clamping section being made of different materials.

47. The machine according to claim 46, wherein the holder is spring mounted on one of, a suction or a ventilation box.

48. The machine according to claim 46, wherein said zone adjoins the interior or exterior wall of a rotating jacket of one of, a suction roll, or a ventilation roll, or a moving belt.

49. The machine according to claim 46, wherein the sealing element comprises a sealing strip extending substantially over the entire roll length.

* * * * *